US008033369B2

(12) United States Patent
Sherrell et al.

(10) Patent No.: US 8,033,369 B2
(45) Date of Patent: Oct. 11, 2011

(54) FULLY RECESSED TRANSLATION BIASED CANTILEVER LEG LUGGAGE DEVICE

(75) Inventors: Gary Sherrell, Maple Valley, WA (US); Michael J. Baum, Seatac, WA (US); William Pangburn, Renton, WA (US); Adam Smith, Palm Desert, CA (US); Cameron Smith, Seattle, WA (US); Glenn Johnson, Mercer Island, WA (US)

(73) Assignee: Club Glider Holdings, LLC, Maple Valley, WA (US)

( * ) Notice: Subject to any disclaimer, the term of this patent is extended or adjusted under 35 U.S.C. 154(b) by 369 days.

(21) Appl. No.: 12/421,436

(22) Filed: Apr. 9, 2009

(65) Prior Publication Data

US 2009/0255772 A1 Oct. 15, 2009

Related U.S. Application Data

(60) Provisional application No. 61/044,945, filed on Apr. 15, 2008.

(51) Int. Cl.
*A45C 5/14* (2006.01)

(52) U.S. Cl. ..... 190/18 A; 280/DIG. 6; 280/47.2; 280/43.1; 280/37

(58) Field of Classification Search ..... 280/47.2, 280/43.1, 37, DIG. 6; 190/18 A
See application file for complete search history.

(56) References Cited

U.S. PATENT DOCUMENTS

| | | | | |
|---|---|---|---|---|
| 4,174,085 | A | 11/1979 | Ferreira et al. | |
| 4,735,392 | A | 4/1988 | Farmer | |
| 5,014,628 | A | 5/1991 | Roberts | |
| 5,519,919 | A * | 5/1996 | Lee | 16/113.1 |
| 5,845,589 | A | 12/1998 | Pfister | |
| 5,984,326 | A * | 11/1999 | Abraham et al. | 280/47.2 |
| 6,079,527 | A * | 6/2000 | Kuo | 190/115 |
| 6,164,425 | A * | 12/2000 | Latshaw | 190/18 A |
| 6,386,119 | B1 | 5/2002 | Lin | |
| 6,401,888 | B1 * | 6/2002 | Kuo | 190/18 A |
| 6,497,311 | B2 * | 12/2002 | Tiramani et al. | 190/115 |
| 6,772,700 | B2 | 8/2004 | Wong | |
| 7,066,099 | B2 | 6/2006 | Tseng | |
| 7,249,563 | B2 | 7/2007 | Chen et al. | |
| 7,314,011 | B2 | 1/2008 | Cattaneo | |
| 7,500,682 | B1 * | 3/2009 | Del Marmol | 280/47.2 |
| 7,837,206 | B1 * | 11/2010 | Lee | 280/37 |
| 2002/0046684 | A1 | 4/2002 | Lin | |
| 2003/0167980 | A1 | 9/2003 | Suzuki | |
| 2004/0211687 | A1 * | 10/2004 | Rodriguez | 206/315.3 |
| 2004/0216970 | A1 * | 11/2004 | Sherrell et al. | 190/18 A |
| 2008/0017463 | A1 * | 1/2008 | Huang | 190/18 A |
| 2010/0078279 | A1 * | 4/2010 | Bowers | 190/18 A |

* cited by examiner

*Primary Examiner* — Tri Mai
(74) *Attorney, Agent, or Firm* — Gallagher & Dawsey Co., LPA; Michael J. Gallagher; David J. Dawsey

(57) ABSTRACT

A luggage device having fully recessed legs that may be selectively engaged to translate and pivot about an axis to facilitate controlled movement from a fully recessed storage position to an operative position for conveniently transporting large heavy objects within the luggage. The fully recessed translation biased cantilever leg luggage device includes a dextral leg recess for receiving a dextral leg, and a sinistral leg recess for receiving a sinistral leg. Each leg recess has an engagement region, a storage region, and a pivot. Additionally, the engagement region includes a leg engagement region storage location, a leg engagement region operative location, and a leg engagement region transition region; through which a portion of the leg pivots about the axis and transitions from the fully recessed storage position to an operative position.

19 Claims, 13 Drawing Sheets

FULLY RECESSED TRANSLATION BIASED CANTILEVER LEG LUGGAGE DEVICE

CROSS-REFERENCE TO RELATED APPLICATIONS

This application claims the benefit of U.S. provisional patent application Ser. No. 61/044,945, filed on Apr. 15, 2008, all of which is incorporated by reference as if completely written herein.

TECHNICAL FIELD

The present invention relates to the field of luggage; particularly, to a luggage device having fully recessed legs that may be selectively engaged to translate and pivot about an axis to facilitate controlled movement from a fully recessed storage position to an operative position for conveniently transporting large heavy objects within the luggage.

BACKGROUND OF THE INVENTION

People have been making specialized luggage devices for use when traveling for centuries. Luggage devices for long objects, such as golf clubs, are more awkward to handle than most luggage devices. If the luggage device for long objects is stood on end, it will easily fall over when bumped, so it is usually handled and placed in a horizontal orientation.

An important improvement for luggage devices was the addition of two built-in wheels along one edge of the luggage opposite a built-in handle. For most luggage devices, these edge wheels allow the luggage to be tilted to near a balance point and then pulled or pushed with the handle opposite the wheels. On paved surfaces, this makes it easy for a person to walk while pushing or pulling the luggage.

However, when luggage devices that are much longer than they are high are heavily loaded, such as luggage devices for golf clubs, the system of two edge wheels and an opposite handle does not work very well. When the long luggage device is tilted to its balance point, the tilt angle is too close to vertical to gain adequate control over the weight of the device. Consequently, the user must tilt the luggage device much closer to horizontal than near the balance point and carry much of the weight in the user's hand, which presents a problem when the luggage device is heavily loaded.

For short, heavily loaded, edge-wheeled luggage devices, the problem can be solved by extending the handle so that most of the weight is on the wheels. Such luggage devices with extendable handles are popular. However, if the luggage is long, longer than about 40 inches, and intended to carry significant weight, extending the handle enough to transfer adequate weight to the wheels would make the length of the tilted luggage device plus extended handle too long for maneuvering through travel stations and around other baggage.

A popular luggage device that particularly suffers from this problem is the travel case for golf clubs. The length of its base is more than twice the height of its side opposite the edge wheels. When loaded with golf clubs, it is quite heavy. When raised at a low enough angle to give adequate control, the weight on a user's hand is undesirably tiresome. A solution to this problem without adding an extension on the handle is needed.

SUMMARY OF THE INVENTION

The present invention provides a solution to the above-described problem by allowing the user to be free from bearing the weight of the luggage device. This is accomplished by providing a luggage device having a pair of fully recessed translation biased cantilever legs that is designed to support the weight of the luggage device when in use. When not in use, the legs are fully recessed in the luggage device. The design facilitates a safe and secure transition to an extended operative position. The fully recessed legs may be selectively engaged to translate and pivot about an axis to facilitate controlled movement from a fully recessed storage position to an extended operative position for conveniently transporting large, heavy objects within the luggage device.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 1:
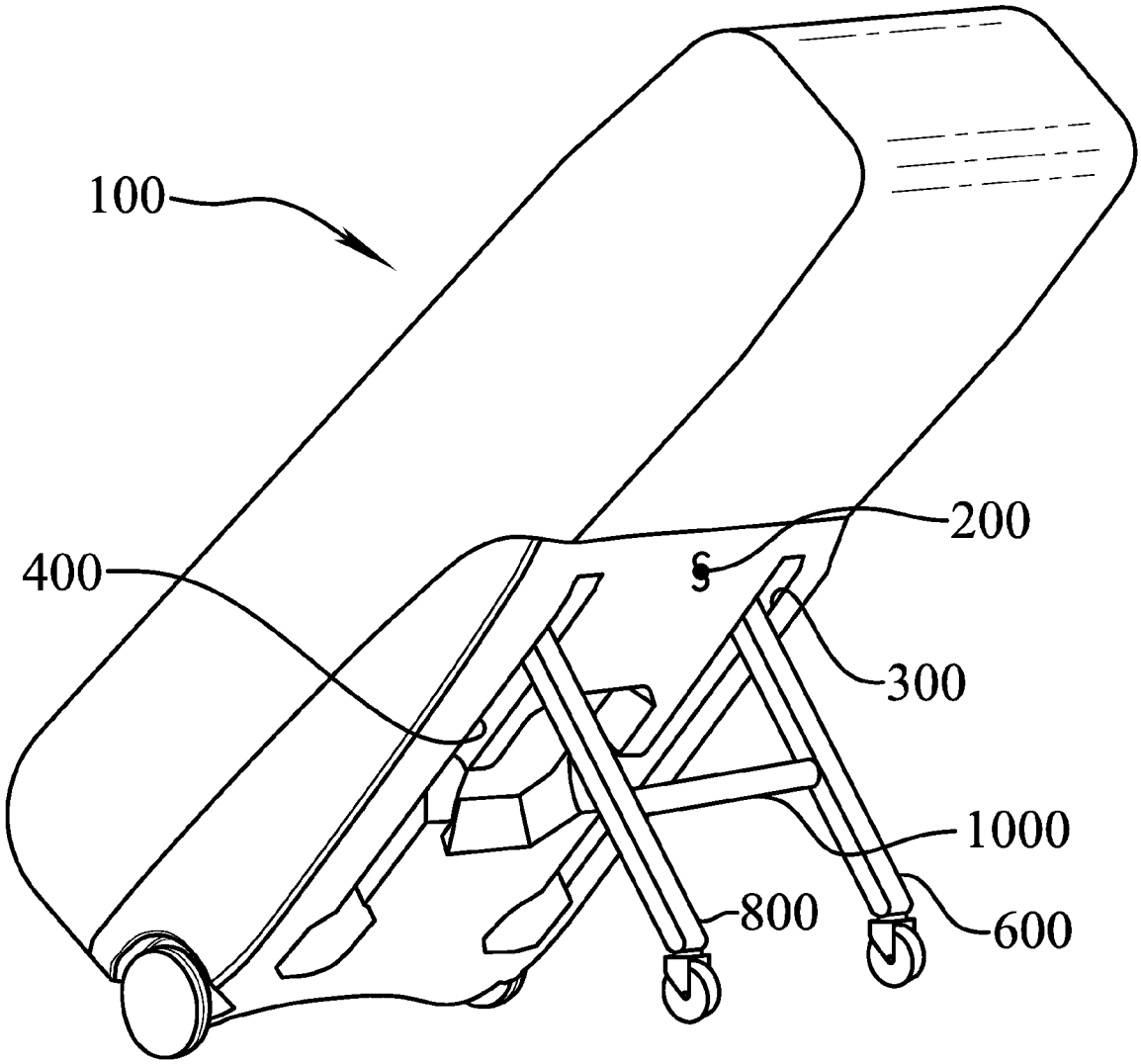
FIG. 1 shows an isometric view of an embodiment of the luggage device, not to scale.

These drawings are provided to assist in the understanding of the exemplary embodiments of the high volume aerodynamic golf club head as described in more detail below and should not be construed as unduly limiting the present golf club head. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DESCRIPTION OF THE INVENTION

The fully recessed translation biased cantilever leg luggage device (100) enables a significant advance in the state of the art. The preferred embodiments of the luggage device (100) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the luggage device (100), and is not intended to represent the only form in which the luggage device (100) may be constructed or utilized. The description sets forth the designs, functions, means, and methods of implementing the luggage device (100) in connection with the illustrated embodiments. It is to be understood, however, that the same or equivalent functions and features may be accomplished by different embodiments that are also intended to be encompassed within the spirit and scope of the claimed luggage device (100).

An embodiment of the fully recessed translation biased cantilever leg luggage device (100) is depicted in FIG. 1. The fully recessed translation biased cantilever leg luggage device (100) includes a dextral leg recess (300) for receiving a dextral leg (600), and a sinistral leg recess (400) for receiving a sinistral leg (800). In one of many embodiments, the luggage device (100) may include a crossbar (1000) having a crossbar diameter, as will be explained later in great detail. Throughout this application reference may be made to either the dextral leg recess (300) and the dextral leg (600), or the sinistral leg recess (400) and the sinistral leg (800); however, one skilled in the art will appreciate that the disclosure with respect to one of the leg recesses (300, 400) is equally applicable to the other leg recess (300, 400), and the disclosure with respect to one of the legs (600, 800) is equally applicable to the other leg (600, 800), with related references to the associated element numbers.

Figure 12:
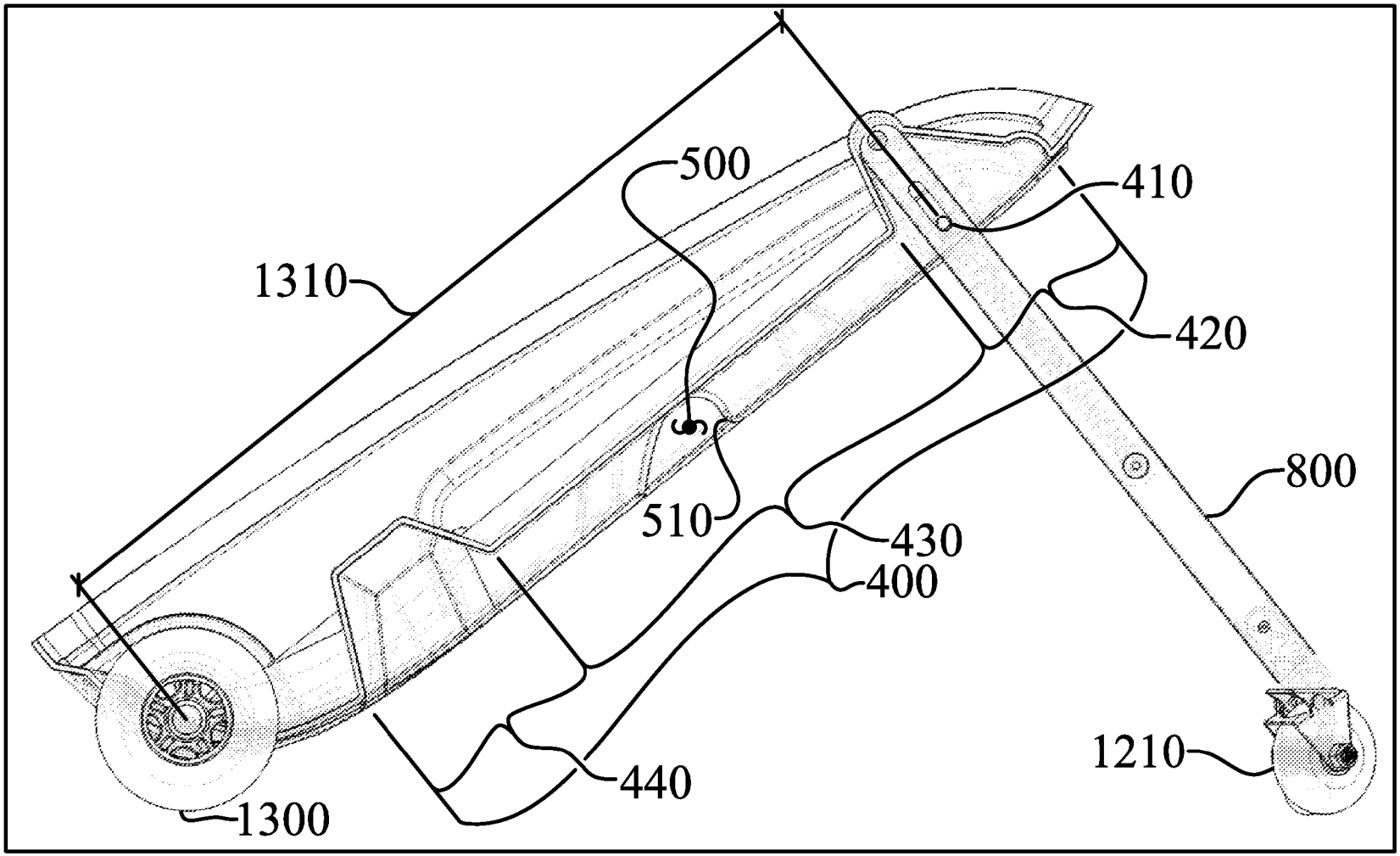
FIG. 12 shows a partial side cross-section view of a portion of an embodiment of the luggage device, not to scale.

First, the leg recesses (300, 400) will be disclosed in detail. The dextral leg recess (300) has a dextral recess leg engagement region (320), a dextral leg storage region (330), and a dextral pivot (310). Likewise, the sinistral leg recess (400) has a sinistral recess leg engagement region (420), a sinistral leg storage region (430), and a sinistral pivot (410). The attributes of the leg recesses (300, 400) are best illustrated in FIG. 12, which shows the sinistral leg recess (400) and associated sinistral leg (800), but is equally applicable to the dextral leg recess (300) and the associated dextral leg (600). Now, focusing more on the sinistral recess leg engagement region (420) and FIG. 13, it includes a sinistral leg engagement region storage location (422), a sinistral leg engagement region operative location (424), and a sinistral leg engagement region transition region (426), each of which plays an important role in its cooperation with the sinistral leg (800).

Figure 4:
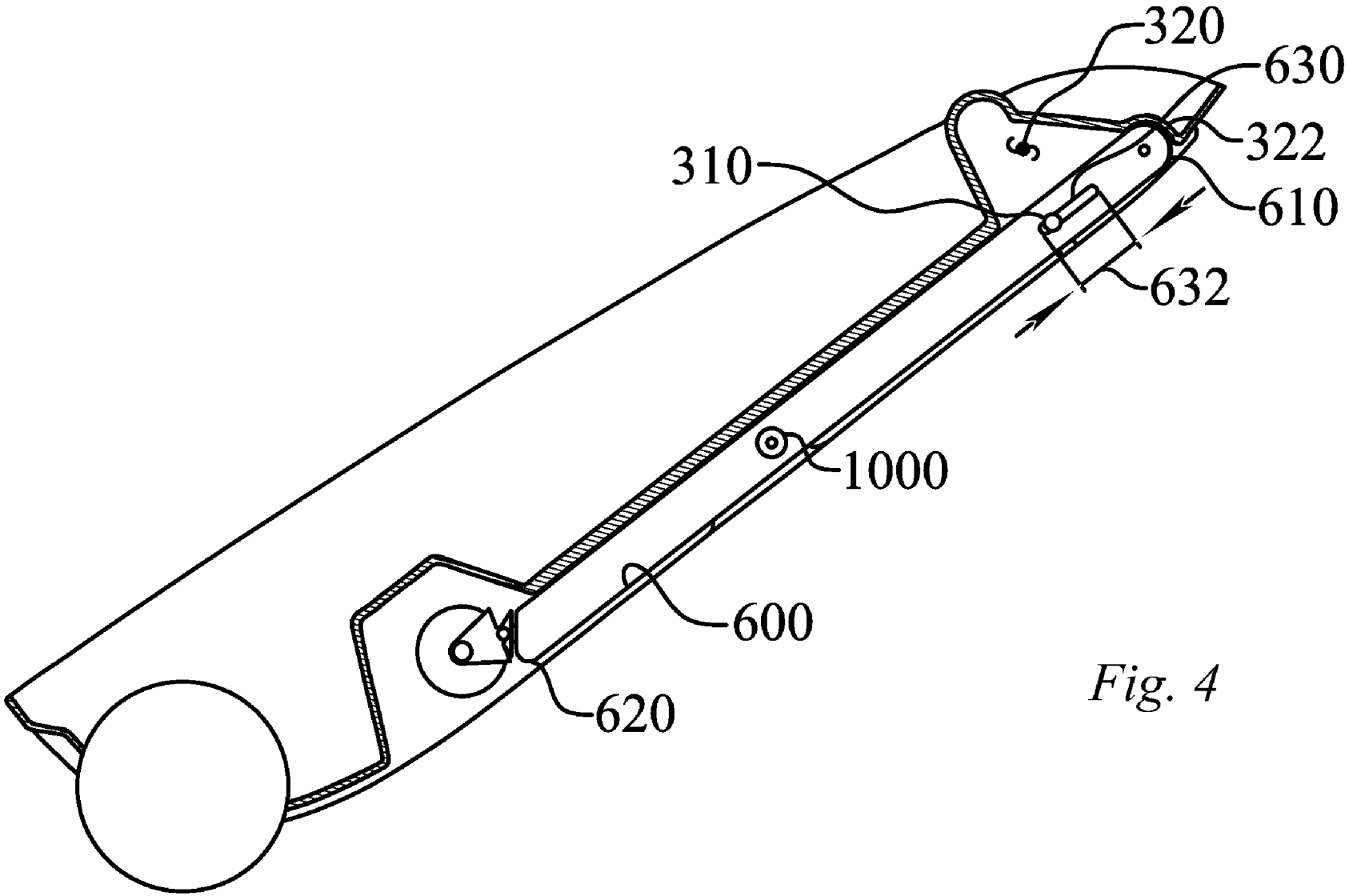
FIG. 4 shows a partial side cross-section view of a portion of an embodiment of the luggage device, not to scale.
Figure 10:
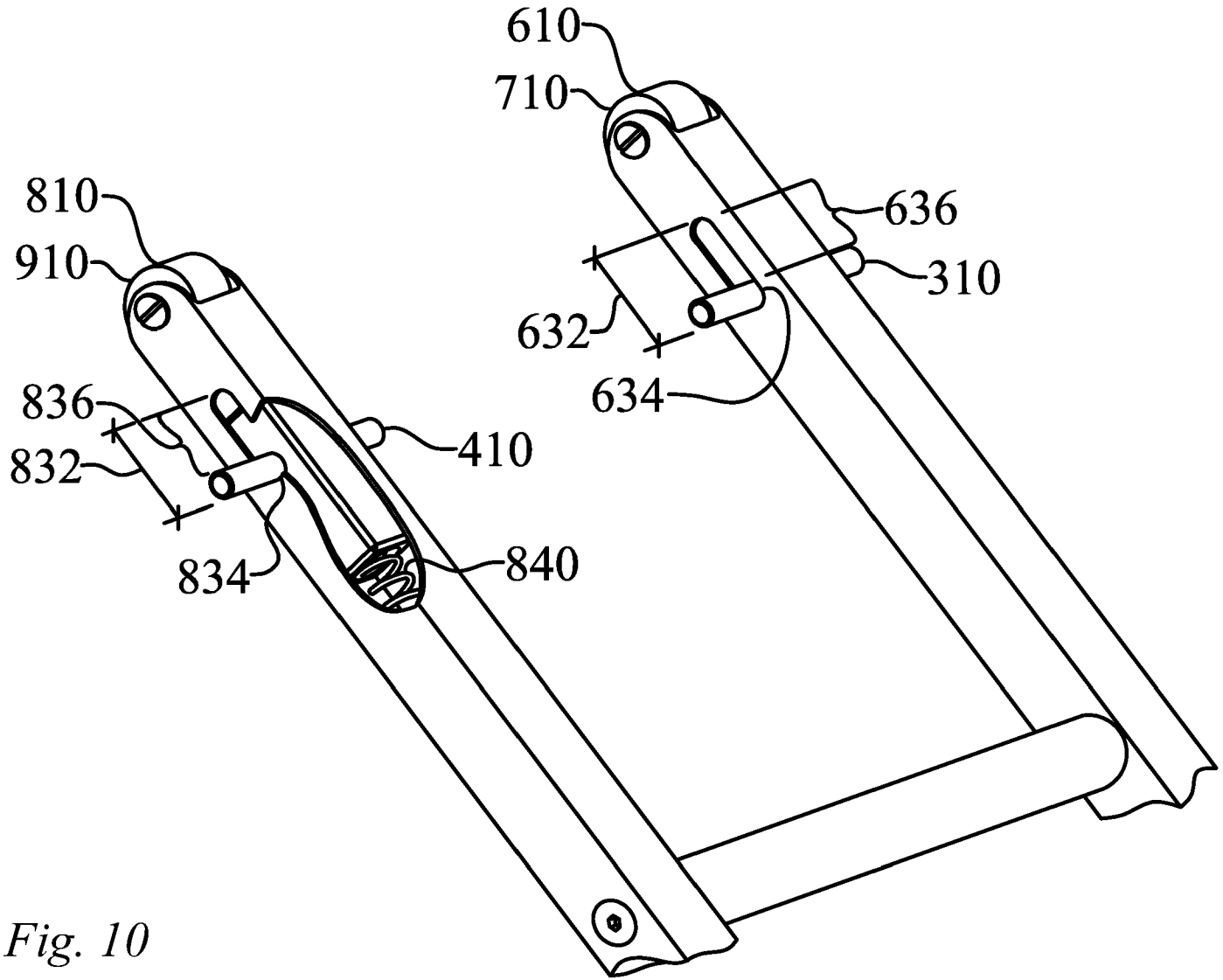
FIG. 10 shows an enlarged partial isometric view of a portion of an embodiment of the luggage device, not to scale.

As illustrated nicely in FIGS. 4-7, each of the legs (600, 800) are uniquely designed to be in rotational and translational cooperation with their respective pivots (310, 410). The series of FIGS. 4-7 illustrate the unique design and relationship with respect to the dextral leg (600) and the dextral leg recess (300) but, as previously explained, apply equally to the associated elements of the sinistral leg (800) and the sinistral leg recess (400). To fully understand this unique rotational and translational cooperation one must first appreciate that each leg (600, 800) contains a biasing mechanism (640, 840) that automatically biases a roller end (620, 820) of each leg (600, 800) toward the pivot (310, 410). Therefore, it is helpful to define that the dextral leg (600) includes a dextral leg engagement end (610) and a dextral leg roller end (620), as seen in FIG. 4. A dextral biasing mechanism (640) biases the dextral roller end (620) toward the dextral pivot (310). Further, the dextral leg (600) includes a dextral pivot slot (630), also seen in FIG. 4, that works in cooperation with the dextral pivot (310). The dextral pivot slot (630) includes a dextral slot length (632) as seen in FIGS. 4 and 10, a dextral slot storage position (634) located near one end of the dextral pivot slot (630), as seen in FIG. 10, and a dextral slot transition region (636), as also seen in FIG. 10.

Figure 7:
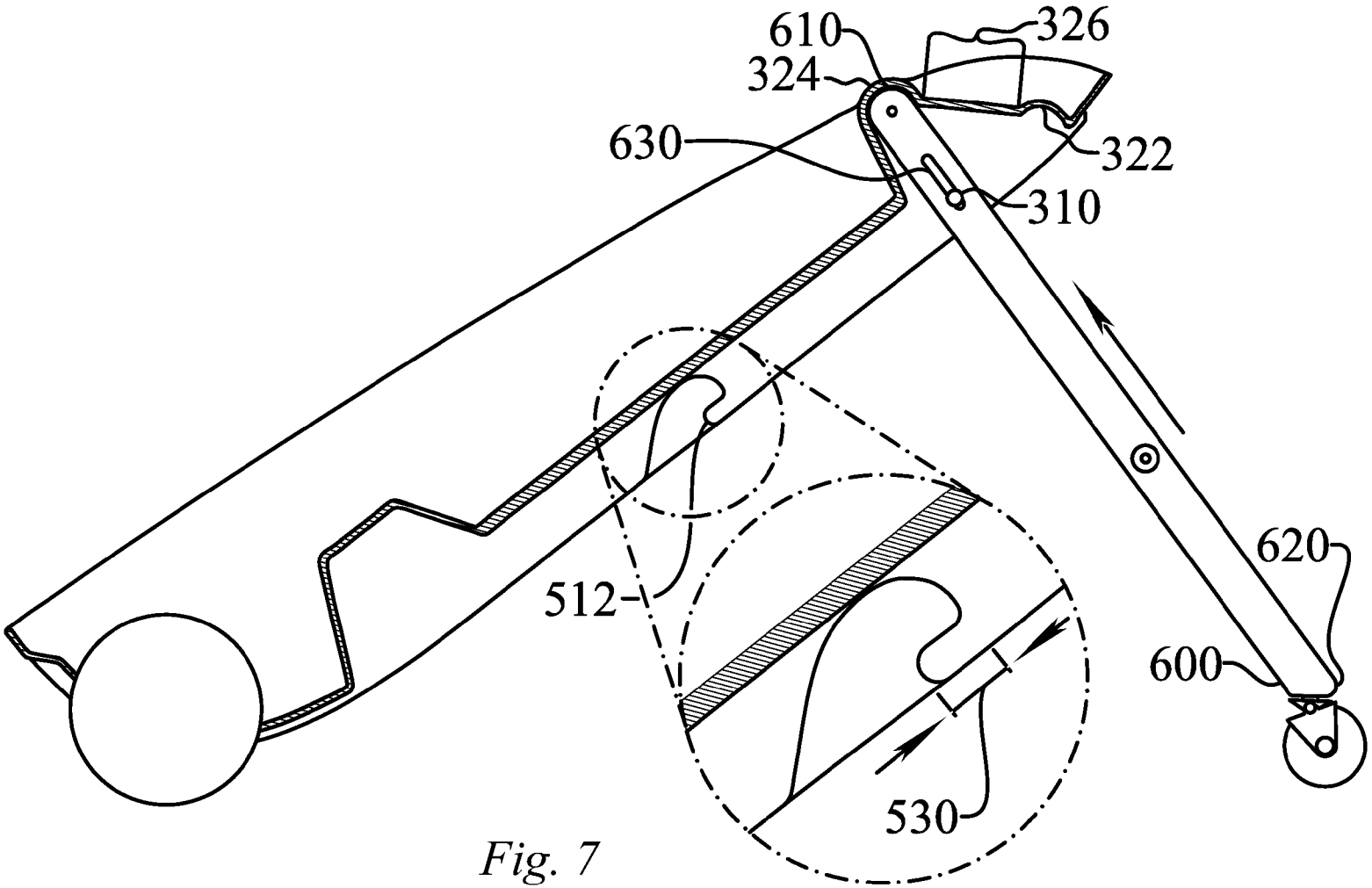
FIG. 7 shows a partial side cross-section view of a portion of an embodiment of the luggage device, not to scale.
Figure 8:
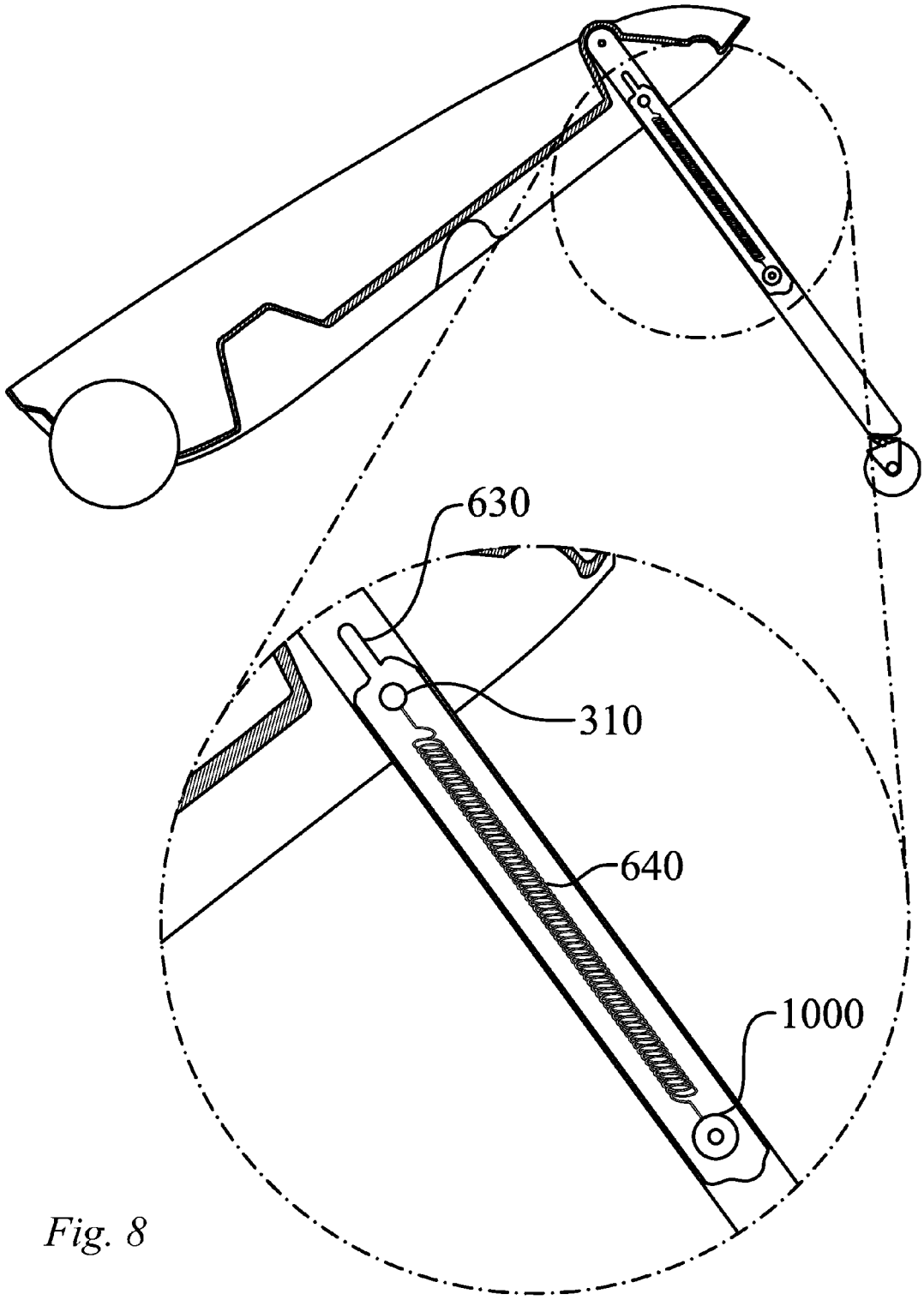
FIG. 8 shows a partial side cross-section view of a portion of an embodiment of the luggage device and a partial enlarged exploded view of a portion of the embodiment, not to scale.

The dextral biasing mechanism (640) is illustrated as a spring in FIG. 8, but may be any biasing means that would be known to one skilled in the art provided that it may be housed within the dextral leg (600) including, but not limited to, spring based systems, elastic fiber, fabric, and polymer systems, shape memory alloy systems, hydraulic systems, pneumatic systems, and magnetic systems, just to name a few. Thus, when the dextral leg (600) is in the storage position of FIG. 4, the dextral biasing mechanism (640) biases the dextral slot storage position (634) to the dextral pivot (310) thereby positioning the dextral leg engagement end (610) in cooperation with the dextral leg engagement region storage location (322), and likewise for the sinistral leg (800) and associated sinistral elements. Thus, the dextral biasing mechanism (640) biases the dextral leg roller end (620) toward the dextral pivot (310) leading to the positioning of FIG. 4, wherein the dextral leg (600) is in the storage position, fully recessed within the luggage device (100). Similarly, the dextral leg (600) has an operative position, shown in FIG. 7, wherein the dextral leg (600) is fully rotated to a position roughly orthogonal to the storage position. In the operative position, the dextral biasing mechanism (640) biases the dextral leg roller end (620) toward the dextral pivot (310) thereby positioning the dextral leg engagement end (610) in cooperation with the dextral leg engagement region operative location (324).

Therefore, the unique design of the luggage device (100) requires a step-wise sequence of events to achieve the rotation of the legs (600, 800) from the safely secured and fully recessed storage position of FIG. 4 to the secure and stable operative position of FIG. 7. The dextral leg (600) is fully recessed and prevented from unintentional rotation when in the storage position of FIG. 4. The internal dextral biasing mechanism (640), seen best in FIG. 8, is pulling the dextral leg roller end (620) toward the dextral pivot (310), and the dextral pivot slot (630) allows the dextral leg (600) to translate with respect to the dextral pivot (310) such that the dextral leg engagement end (610) cooperates with the dextral leg engagement region storage location (322), thereby preventing unintentional rotation of the dextral leg (600) about the dextral pivot (310).

Figure 5:
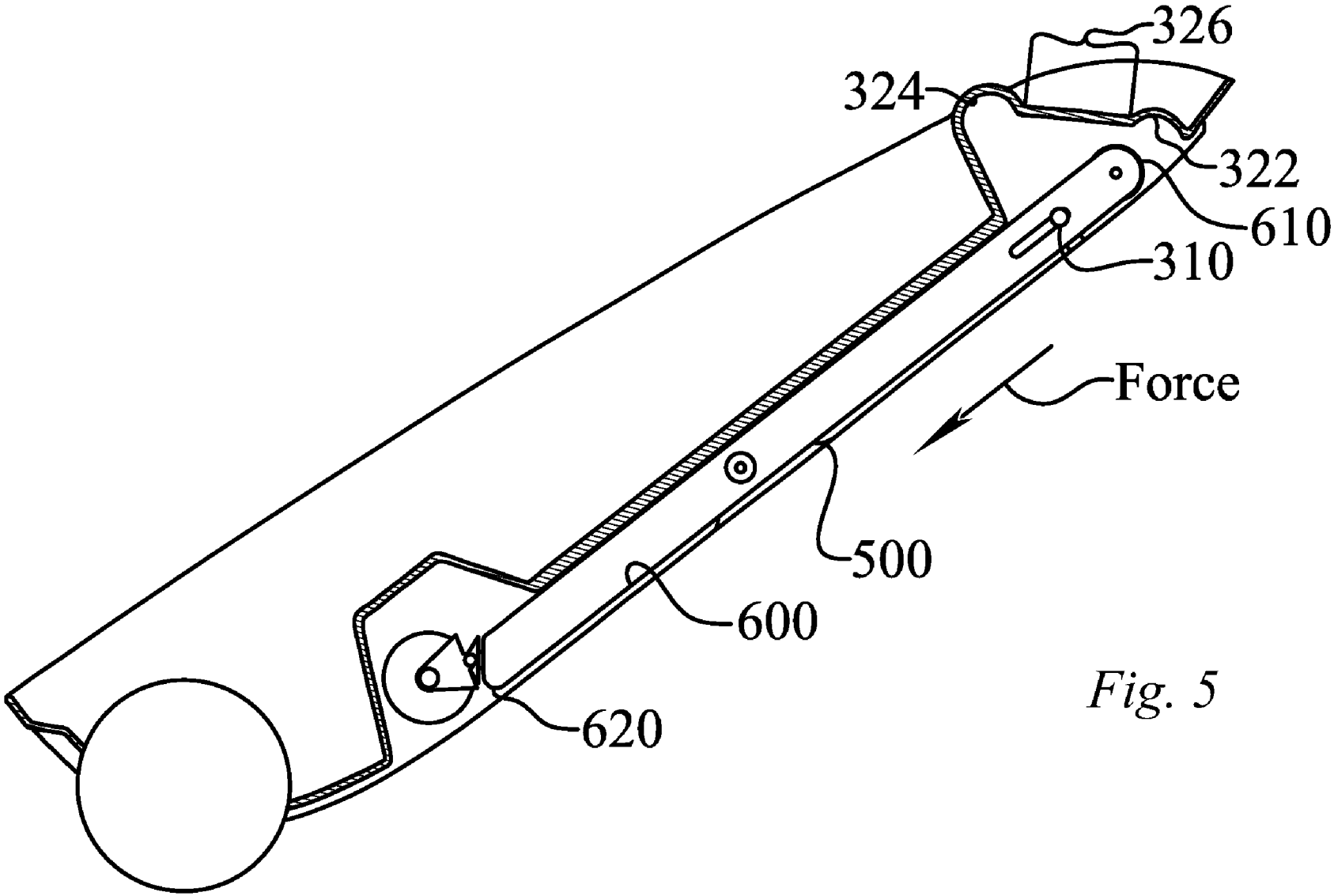
FIG. 5 shows a partial side cross-section view of a portion of an embodiment of the luggage device, not to scale.

Now, the specific sequence of steps to successfully transition the luggage device (100) from the storage position to the operative position will be described. As seen in FIG. 5, one step in the process is to disrupt the automatic cooperation of the dextral leg engagement end (610) and the dextral leg engagement region storage location (322), which may be accomplished by creating a physical space between them. To do this, a force must be applied to the dextral leg (600) in a direction opposite the biasing direction of the dextral biasing mechanism (640), which in this case means that a force must be applied that pulls the dextral leg (600) away from the dextral pivot (310) toward the dextral leg roller end (620) along the longitudinal axis of the dextral leg (600), as illustrated by the force arrow in FIG. 5.

Figure 6:
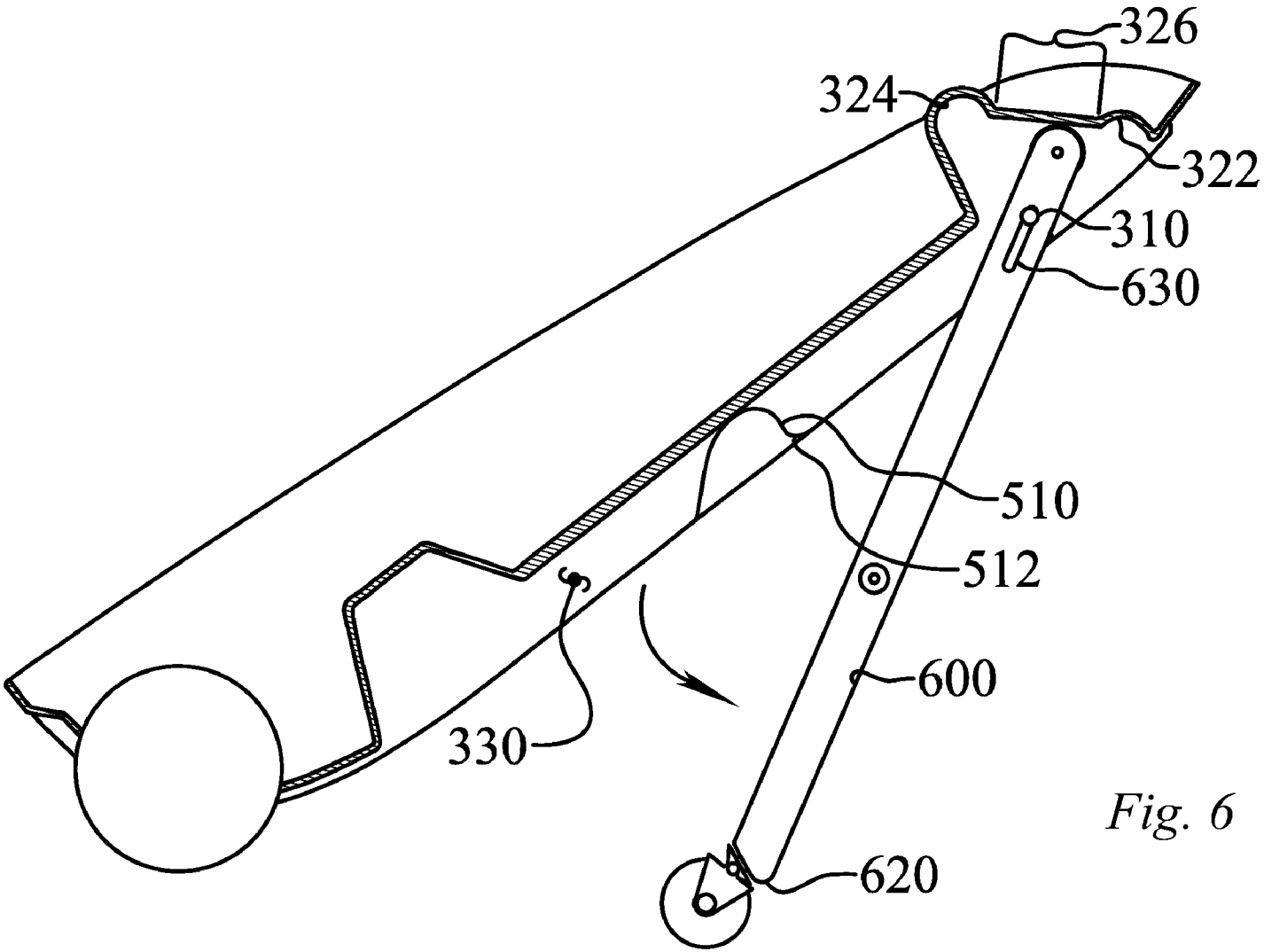
FIG. 6 shows a partial side cross-section view of a portion of an embodiment of the luggage device, not to scale.

Having released the automatic cooperation of the dextral leg engagement end (610) and the dextral leg engagement region storage location (322), the dextral leg engagement end (610) is free to rotate about the dextral pivot (310) and enter into the dextral leg engagement region transition region (326), as seen in FIG. 6. At the point illustrated in FIG. 6, the dextral leg (600) has translated away from the dextral pivot (310) such that the dextral pivot (310) is now in cooperation with a different portion of the dextral pivot slot (630), and the dextral leg (600) has rotated roughly thirty degrees about the dextral pivot (310), and the dextral biasing mechanism (640) is forcing the dextral leg roller end (620) toward the dextral pivot (310). As will be explained in greater detail later, the dextral leg engagement region transition region (326) is not limited to a flat surface as seen in FIG. 7, but may incorporate curved surfaces, either convex or concave, and may incorporate multiple and complex curvatures. This is also true of the dextral leg engagement region storage location (322) and the dextral leg engagement region operative location (324), which are illustrated herein as just one embodiment incorporating concave recesses.

Finally, the dextral leg engagement end (610) leaves the dextral leg engagement region transition region (326) and enters the dextral leg engagement region operative location (324), as seen in FIG. 7. At this point the dextral leg (600) is securely in the operative position with the dextral leg (600) having rotated about the dextral pivot (310) approximately ninety degrees from the storage position, while the dextral leg (600) has also translated in at least two directions with respect to the dextral pivot (310).

Therefore, in order to pivot the dextral leg (600) from the recessed storage position to the operative position, the dextral leg (600) must be translated in a direction opposite the bias of the dextral biasing mechanism (640) to release the cooperation of the dextral leg engagement end (610) and the dextral leg engagement region storage location (322) such that the dextral leg engagement end (610) cooperates with the dextral leg engagement region transition region (326) as the dextral leg (600) pivots toward the operative position until the bias of the dextral biasing mechanism (640) results in the cooperation of the dextral leg engagement end (610) and the dextral leg engagement region operative location (324). Further, to pivot the dextral leg (600) from the operative position to the recessed storage position, the dextral leg (600) must be translated in a direction opposite the bias of the dextral biasing mechanism (640) to release the cooperation of the dextral leg engagement end (610) and the dextral leg engagement operative location (324) such that the dextral leg engagement end (610) cooperates with the dextral leg engagement region transition region (326) as the dextral leg (600) pivots toward the storage position until the bias of the dextral biasing mechanism (640) results in the cooperation of the dextral leg engagement end (610) and the dextral leg engagement region storage location (322). As previously expressed, while much of the prior disclosure and drawings reference the dextral leg recess (300) and dextral leg (600), all of the disclosure and drawings apply equally to the sinistral leg recess (400) and sinistral leg (800).

Similar to the dextral leg (600), the sinistral leg (800) also has a sinistral biasing mechanism (840), wherein the sinistral leg (800) has a sinistral leg engagement end (810), a sinistral leg roller end (820) that the sinistral biasing mechanism (840) biases toward the sinistral pivot (410), and a sinistral pivot slot (830) in cooperation with the sinistral pivot (410), as seen in FIGS. 9-13. The sinistral pivot slot (830) has a sinistral slot length (832), a sinistral slot storage position (834), and a sinistral slot transition region (836), as seen in FIG. 10. Thus, as already explained with reference to the dextral leg (600), the sinistral leg (800) has a storage position fully recessed within the luggage device (100), wherein the sinistral biasing mechanism (840) biases the sinistral slot storage position (834) to the sinistral pivot (410) thereby positioning the sinistral leg engagement end (810) in cooperation with the sinistral leg engagement region storage location (422).

Additionally, the sinistral leg (800) has an operative position, identical to that of the dextral leg (600), extending from the luggage device (100) wherein the sinistral biasing mechanism (840) biases the sinistral leg roller end (820) toward the sinistral pivot (410) thereby positioning the sinistral leg engagement end (810) in cooperation with the sinistral leg engagement region operative location (424). The sinistral leg (800) translates and rotates about the sinistral pivot (410) to transition the sinistral leg (800) from the recessed storage position to the operative position. The explanation of the sequence of operation of the sinistral leg (800) is identical to that previously explained in great detail for the dextral leg (600); thus, the sinistral leg (800) sequence of operation will be brief and focus on FIGS. 12 and 13. To pivot the sinistral leg (800) from the recessed storage position, seen in FIG. 13, to the operative position, seen in FIG. 12, the sinistral leg (800) must be translated in a direction opposite the bias of the sinistral biasing mechanism (840) to release the cooperation of the sinistral leg engagement end (810) and the sinistral leg engagement region storage location (422) such that the sinistral leg engagement end (810) cooperates with the sinistral leg engagement region transition region (426) as the sinistral leg (800) pivots toward the operative position until the bias of the sinistral biasing mechanism (840) results in the cooperation of the sinistral leg engagement end (810) and the sinistral leg engagement region operative location (424). Further, to pivot the sinistral leg (800) from the operative position to the recessed storage position, the sinistral leg (800) must be translated in a direction opposite the bias of the sinistral biasing mechanism (840) to release the cooperation of the sinistral leg engagement end (810) and the sinistral leg engagement operative location (424) such that the sinistral leg engagement end (810) cooperates with the sinistral leg engagement region transition region (426) as the sinistral leg (800) pivots toward the storage position until the bias of the sinistral biasing mechanism (840) results in the cooperation of the sinistral leg engagement end (810) and the sinistral leg engagement region storage location (422).

Figure 2:
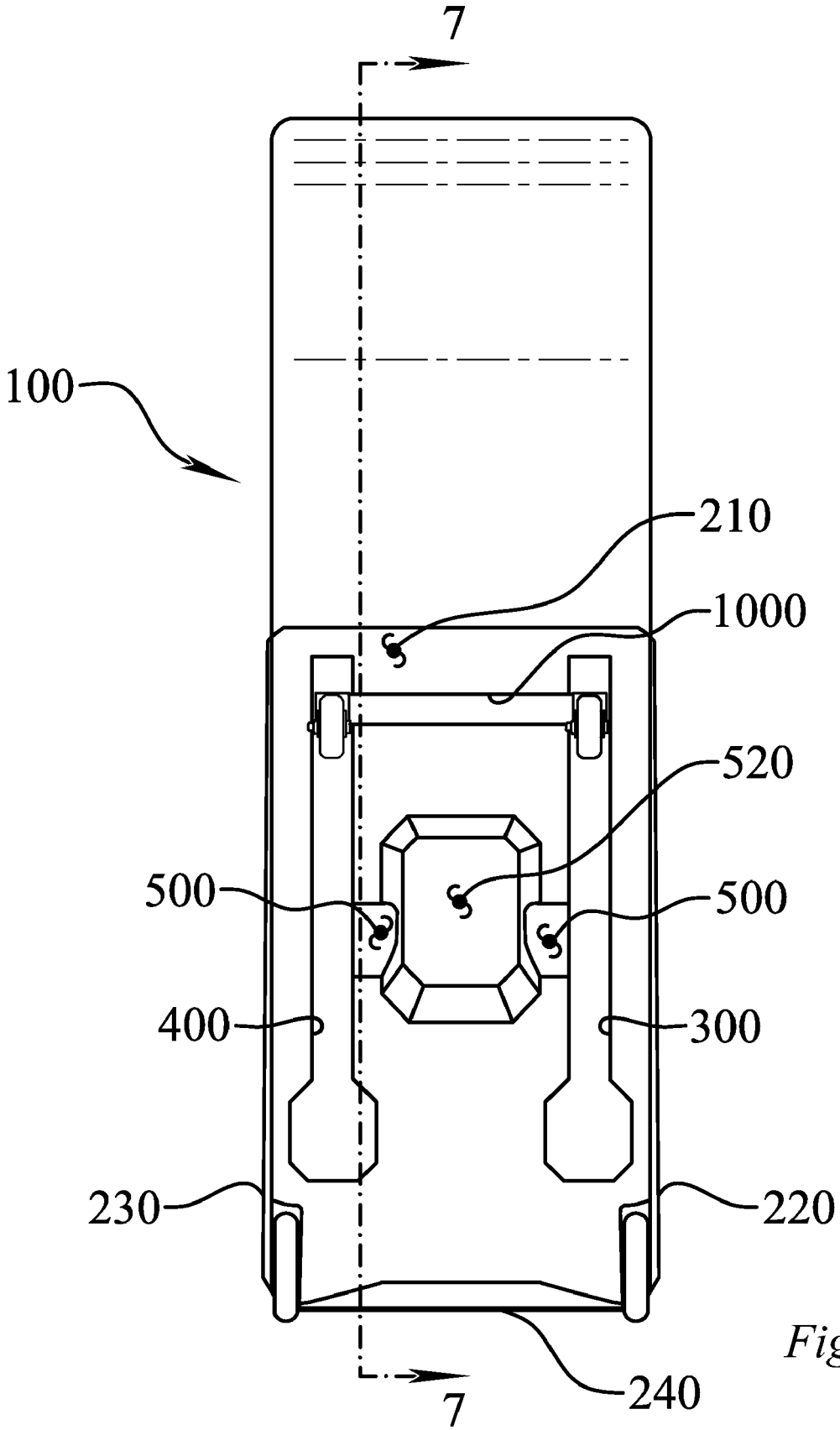
FIG. 2 shows a front elevation view of an embodiment of the luggage device, not to scale.
Figure 3:
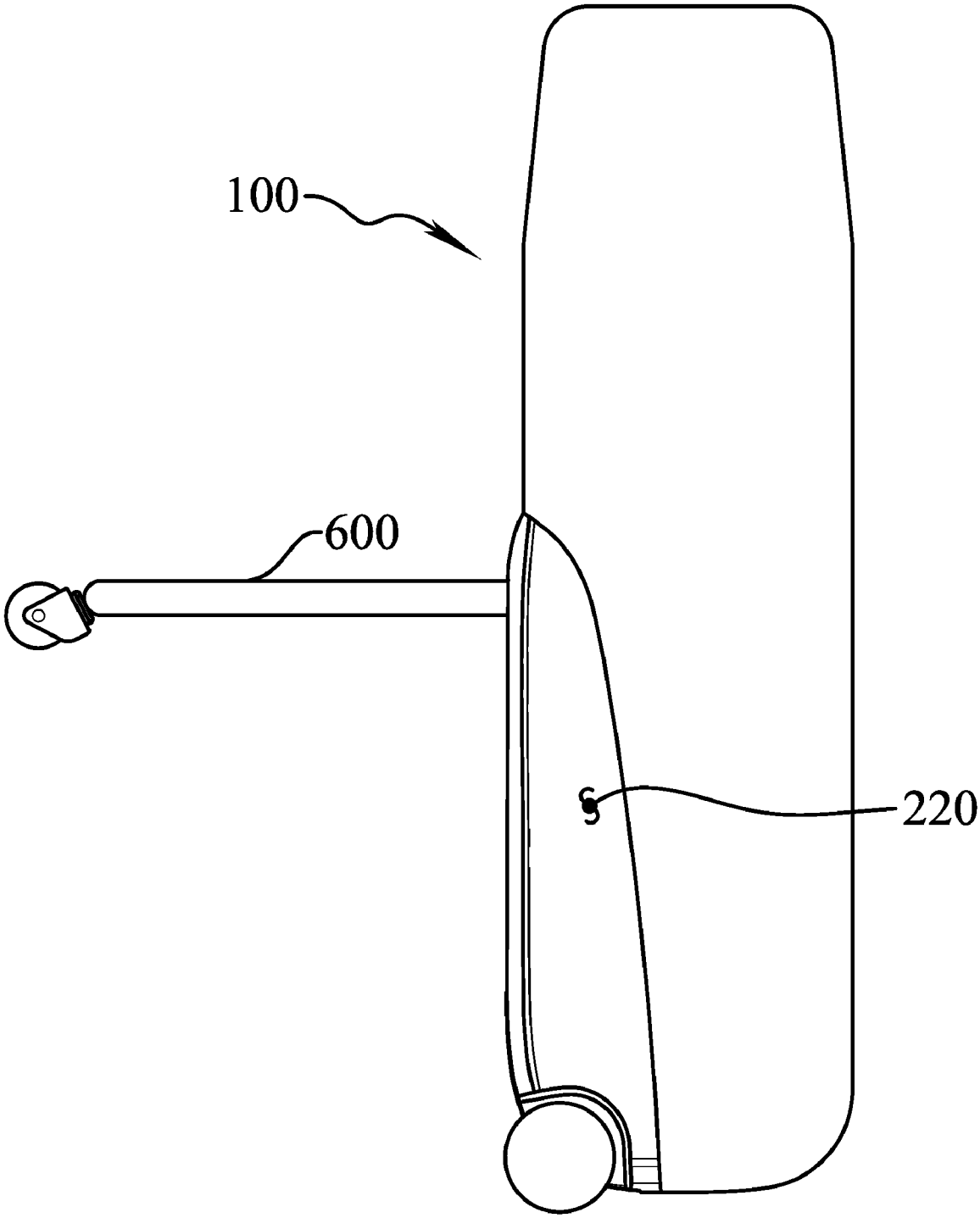
FIG. 3 shows a side elevation view of an embodiment of the luggage device, not to scale.

As seen well in FIG. 1, the luggage device (100) may further include a crossbar (1000) connecting the dextral leg (600) and the sinistral leg (800). In this embodiment, the crossbar (1000) may add rigidity to the dextral leg (600) and the sinistral leg (800), and ensure that legs (600, 800) move in unison. In yet a further embodiment, as seen in FIG. 2, the luggage device (100) includes a rotation prevention recess (500) formed in the luggage device (100) such that the rotation prevention recess (500) cooperates with the crossbar (1000) connecting the dextral leg (600) and the sinistral leg (800). In this embodiment, the crossbar (1000) must be translationally displaced in a direction opposite the bias of the dextral biasing mechanism (640) and the sinistral biasing mechanism (840) by a rotation prevention recess minimum offset distance (530), seen in FIG. 7, to release the cooperation of the rotation prevention recess (500) and the crossbar (1000). This displacement facilitates simultaneous movement of (a) the dextral leg engagement end (610) from the dextral leg engagement region storage location (322), and (b) the sinistral leg engagement end (810) from the sinistral leg engagement region storage location (422), which permits the transitioning of the dextral leg (600) and the sinistral leg (800) from the recessed storage position to the operative position.

The rotation prevention recess minimum offset distance (530) assures safety during the handling and operation of the luggage device (100). As noted above, in order to place the legs (600, 800) in the operative position, the crossbar (1000) must be translationally displaced a distance greater than the rotation prevention recess minimum offset distance (530).

Such a distance helps ensure that the legs (600, 800) are brought into the operative position only when there is an intent to do so. Any incidental contact, which is likely to be experienced during baggage handling operations, is not likely to place the legs (600, 800) in the operative position. Thus, the legs (600, 800) will be safely recessed within the luggage device (100) until a user intends to place the legs (600, 800) in the operative position. In one embodiment, the rotation prevention recess minimum offset distance (530) is at least fifty percent of the crossbar diameter. In yet another embodiment, the rotation prevention recess minimum offset distance (530) is greater than or equal to the crossbar diameter. In still another embodiment, the rotation prevention recess minimum offset distance (530) is in the range of about ¼ of an inch to about 3 inches. Such distances ensure that the luggage device (100) may be safely handled without the threat of the legs (600, 800) being unintentionally moved to the operative position, which could cause harm to baggage handling personnel or disrupt the baggage handling process.

In yet another embodiment, the rotation prevention recess (500) forms a gripping recess (520), seen as the central recess of FIG. 2 between the two rotation prevention recesses (500), sized to permit a human hand to grip the recessed crossbar (1000) and apply a reverse bias force to translate the crossbar (1000) free of the rotation prevention recess (500). In yet another embodiment, seen in FIG. 12, the rotation prevention recess (500) includes a rotation prevention ledge (510). Still further, the rotation prevention ledge (510) includes a dextral rotation prevention ledge (512), as seen in FIG. 7, and a sinistral rotation prevention ledge (514). In yet a further embodiment, the crossbar (1000) does not extend all the way between the legs (600, 800), but rather consists of a short lug extending from each leg (600, 800) toward the opposing leg (600, 800). Thus, in this embodiment, each short lug may cooperate with the rotation prevention recess (500) to achieve the rotation prevention benefits disclosed above.

Still a further embodiment includes a dextral leg translation assistance device (700) and a sinistral leg translation assistance device (900), wherein the dextral leg translation assistance device (700) promotes reduced friction movement of the dextral leg engagement end (610) through the dextral leg engagement region transition region (326), and the sinistral leg translation assistance device (900) promotes reduced friction movement of the sinistral leg engagement end (810) through the sinistral leg engagement region transition region (426). The translation assistance devices (700, 900) may be virtually any friction reducing device including, but not limited to, low-friction surfaces, bearings, or magnets, regardless of the location. In fact, in one particular embodiment the dextral leg translation assistance device (700) includes a dextral leg engagement end roller (710) rotably mounted to the dextral leg engagement end (610), and the sinistral leg translation assistance device (900) includes a sinistral leg engagement end roller (910) rotably mounted to the sinistral leg engagement end (810), as seen in FIG. 10.

Figure 9:
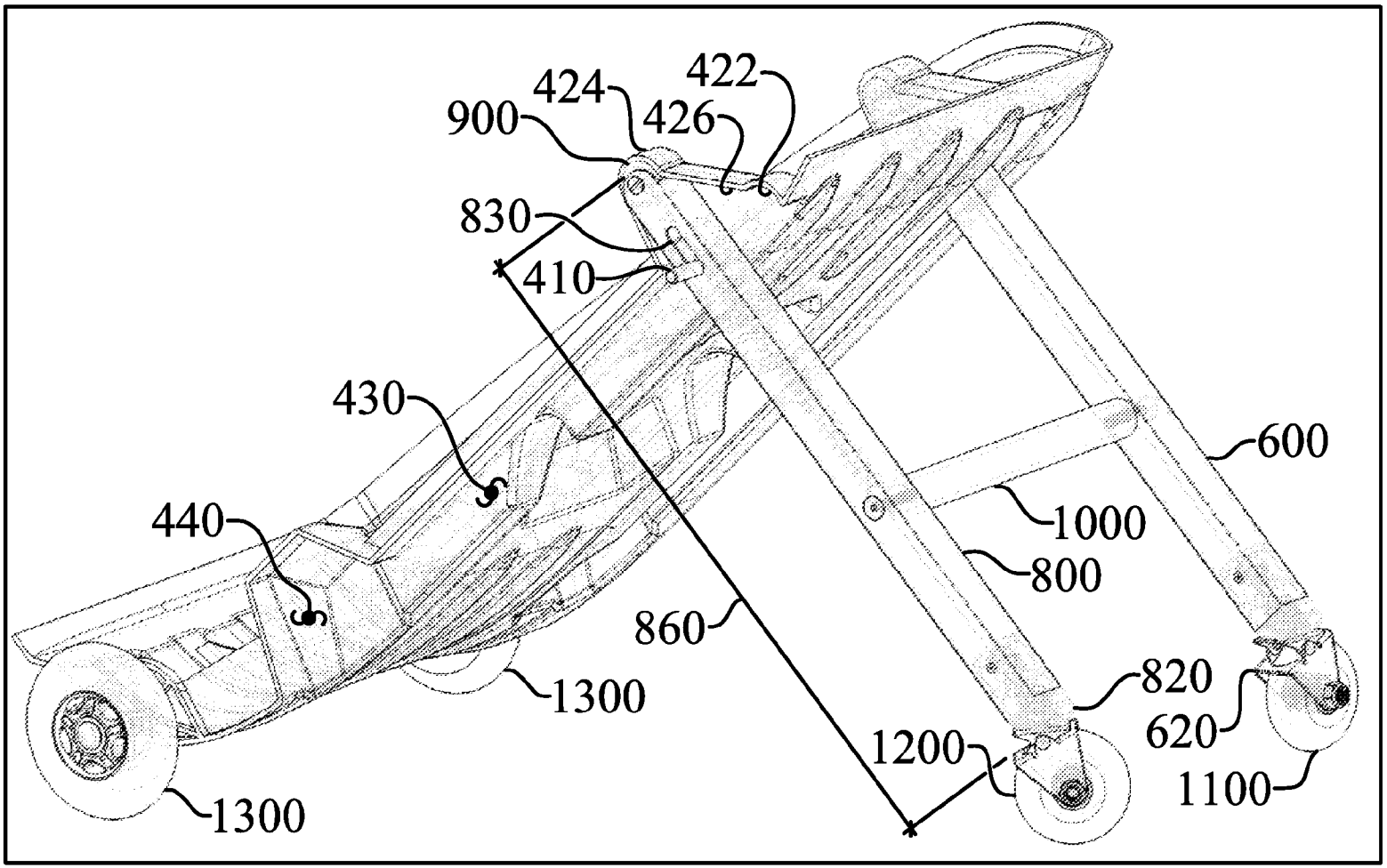
FIG. 9 shows a partial isometric view of a portion of an embodiment of the luggage device, not to scale.

In yet another embodiment, the luggage device (100) includes a dextral roller (1100) attached to the dextral leg roller end (620), and a sinistral roller (1200) attached to the sinistral leg roller end (820), as seen in FIG. 9. The rollers (1100, 1200) may be uni-directional rollers; however, in yet a further embodiment, the dextral roller (1100) is a dextral caster (1110), and the sinistral roller (1200) is a sinistral caster (1210), as seen in FIG. 12. In still a further embodiment, the luggage device (100) includes at least one base roller (1300) located at a corner edge of the luggage device (100) and separated from an axis of the dextral pivot (310) and the sinistral pivot (410) by a base roller to pivot distance (1310), as seen in FIG. 12. The at least one base roller (1300) may be a single multi-directional roller, i.e. a caster, or multiple uni-directional rollers may be used.

Yet a further embodiment recognizes a unique relationship between the dextral slot length (632) and the sinistral slot length (832), and the luggage device's (100) resistance to unintentional opening. In this embodiment, the dextral slot length (632) and the sinistral slot length (832) are preferably at least 0.5 inches. Still further, the resistance, or biasing force, of the biasing mechanisms (640, 840) is preferably at least 5 pounds per inch. In a further embodiment, the translational force required to transition the legs (600, 800) from the storage position to the operative position is at least 5 pounds of force, more preferably at least 10 pounds of force. Yet, it is preferred to require a translational force of less than 30 pounds of force. Such unique translational force ranges provide the safety needed to allow convenient operation by the user and the necessary safety of airline baggage handlers.

Figure 11:
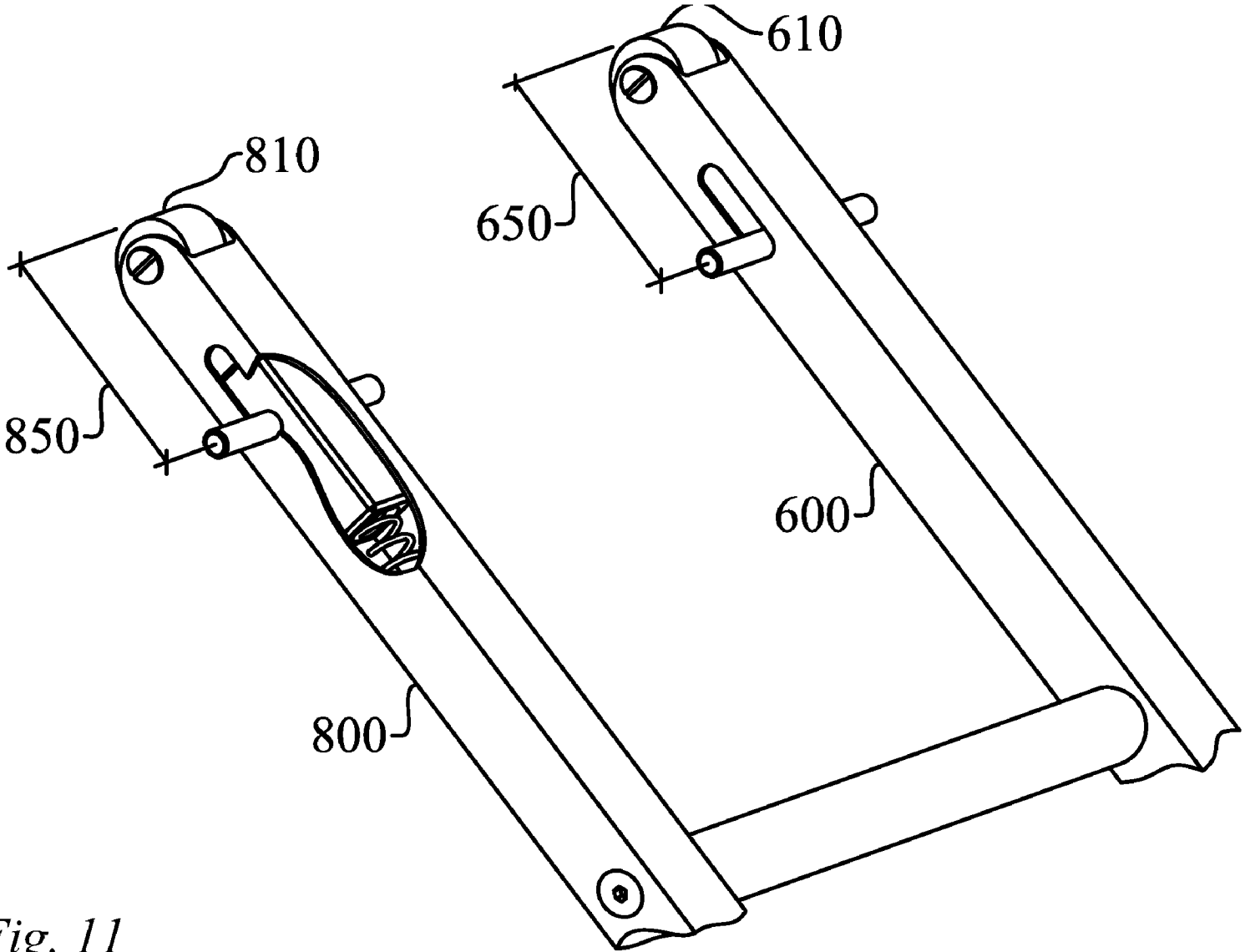
FIG. 11 shows an enlarged partial isometric view of a portion of an embodiment of the luggage device, not to scale.

In yet a further embodiment, the luggage device (100) further recognizes unique relationships that provide heightened stability and safety. In this embodiment, the sinistral leg (800) has a sinistral leg cantilever distance (850) measured from the sinistral pivot (410), when in the operative position as seen in FIG. 11, to the sinistral leg engagement end (810) that is at least 10 percent of the sinistral leg length (860). Likewise, in this embodiment the dextral leg (600) has a dextral leg cantilever distance (650) measured from the dextral pivot (310), when in the operative position as seen in FIG. 11, to the dextral leg engagement end (610) that is at least 10 percent of the dextral leg length (660).

Figure 13:
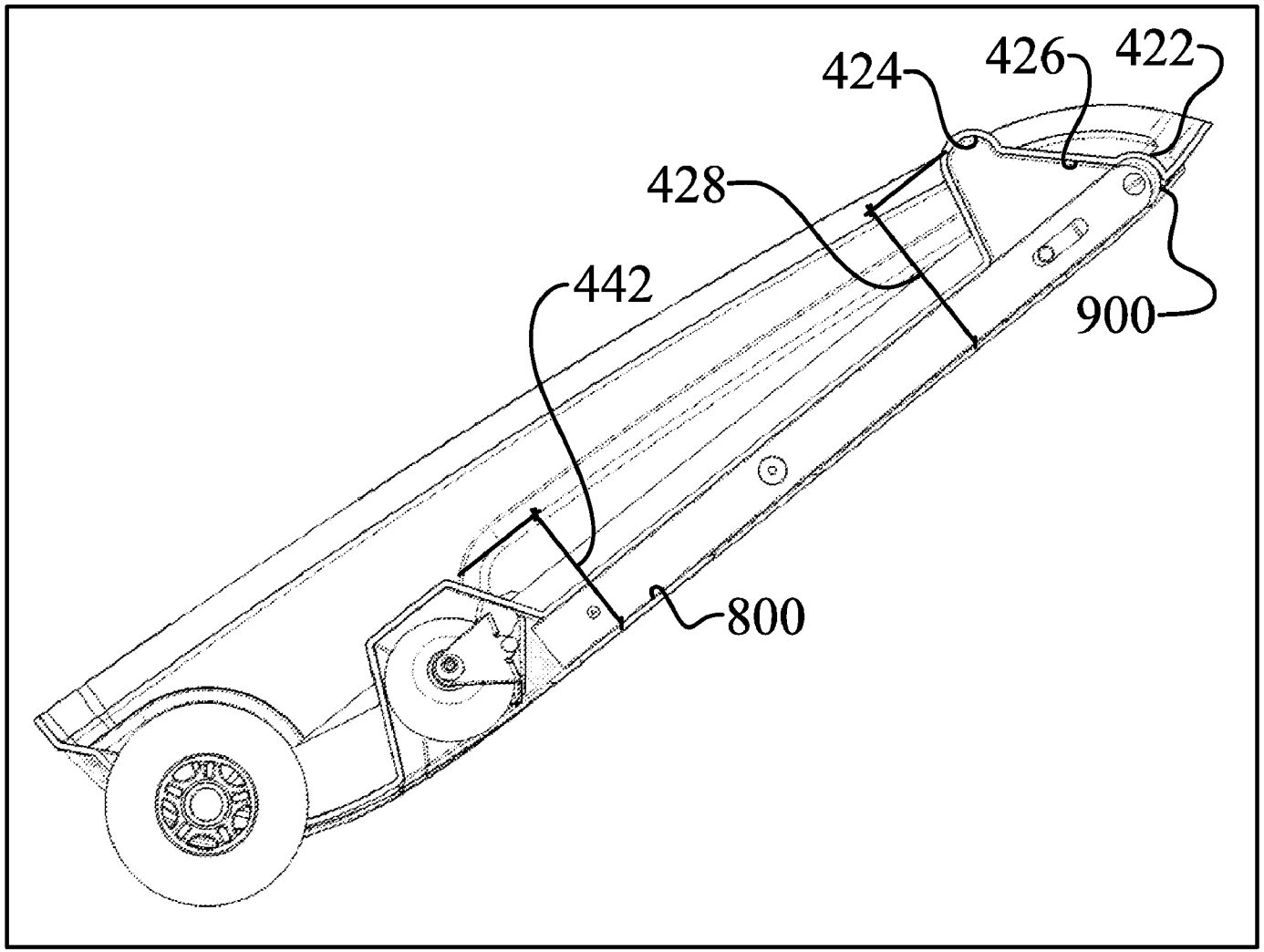
FIG. 13 shows a partial side cross-section view of a portion of an embodiment of the luggage device, not to scale.

Yet, the cantilever distances (650, 850) cannot be made so large as to impact the storage capacity of the luggage device (100). Thus, in yet another embodiment, the sinistral leg recess (400) has a sinistral leg engagement region max depth (428) measured from the most exterior point of sinistral leg (800), when in the storage position as seen in FIG. 13, to the most interior projection of the sinistral recess leg engagement region (420), and a sinistral roller storage region max depth (442) measured from the most exterior point of sinistral leg (800), when in the storage position as seen in FIG. 13, to the most interior projection of the sinistral roller storage region (440). Likewise, one skilled in the art will appreciate that the dextral leg recess (300) has identically measured dextral leg engagement region max depth (328) and dextral roller storage region max depth (342). One of many unique relationships identified by this embodiment is that the sinistral leg engagement region max depth (428) and dextral leg engagement region max depth (328) should be no more than 30 percent of the sinistral leg length (860) and the dextral leg length (660). Yet in a further embodiment the engagement region max depths (328, 428) should be less than the diameter of the at least one base roller (1300). Additionally, in an even further embodiment, the engagement region max depths (328, 428) are less than 4 times the slot lengths (632, 832). Even further, the sinistral roller storage region max depth (442) and dextral roller storage region max depth (342) should be no more than 20 percent of the sinistral leg length (860) and the dextral leg length (660). In yet a further embodiment, the storage region max depths (342, 442) should be less than 75 percent of the diameter of the at least one base roller (1300). Thus, in yet a further embodiment the cantilever distances (650, 850) are less than 30 percent of the base roller to pivot distance (1310) thereby providing a uniquely safe and stable relationship among the cantilever distances (650, 850), leg lengths (660, 860), and storage capacity.

The luggage device (100) may be a flexible soft-case type travel bag, a rigid hard-case type travel bag, or a hybrid type travel bag having both flexible soft-case type portions and rigid hard-case type portions. In fact, the pivots (310, 410) are the only portions of the luggage device (100), other than the legs (600, 800), that must be rigid; however, the luggage device (100) may include larger rigid portions around the pivots (310, 410) referred to as a pivot carriage (200). Likewise, the pivot carriage (200) may be permanently attached to the luggage device (100) or it may be releasably attached. When the pivot carriage (200) is releasably attached, it may be done so via straps, clips, snaps, or any other releasable attachment means known to those with skill in the art.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A fully recessed translation biased cantilever leg luggage device (100), comprising:

a) a dextral leg recess (300) having a dextral recess leg engagement region (320), a dextral leg storage region (330), and a dextral pivot (310), wherein the dextral recess leg engagement region (320) includes:

(i) a dextral leg engagement region storage location (322);

(ii) a dextral leg engagement region operative location (324); and (iii) a dextral leg engagement region transition region (326);

b) a sinistral leg recess (400) having a sinistral recess leg engagement region (420), a sinistral leg storage region (430), and a sinistral pivot (410), wherein the sinistral recess leg engagement region (420) includes:

(i) a sinistral leg engagement region storage location (422);

(ii) a sinistral leg engagement region operative location (424); and (iii) a sinistral leg engagement region transition region (426);

c) a dextral leg (600) in rotational and translational cooperation with the dextral pivot (310) including a dextral biasing mechanism (640), wherein the dextral leg (600) has a dextral leg engagement end (610), a dextral leg roller end (620) that the dextral biasing mechanism (640) biases toward the dextral pivot (610), and a dextral pivot slot (630) in cooperation with the dextral pivot (310), and wherein the dextral pivot slot (630) has a dextral slot length (632), a dextral slot storage position (634), and a dextral slot transition region (636), such that;

(i) the dextral leg (600) has a storage position fully recessed within the device (100) wherein the dextral biasing mechanism (640) biases the dextral slot storage position (634) to the dextral pivot (310) thereby positioning the dextral leg engagement end (610) in cooperation with the dextral leg engagement region storage location (322);

(ii) the dextral leg (600) has an operative position extending from the device (100) wherein the dextral biasing mechanism (640) biases the dextral leg roller end (620) toward the dextral pivot (310) thereby positioning the dextral leg engagement end (610) in cooperation with the dextral leg engagement region operative location (324); and (iii) the dextral leg (600) pivots about the dextral pivot (310) to rotate from the recessed storage position to the operative position, and (a) to pivot the dextral leg (600) from the recessed storage position to the operative position the dextral leg (600) must be translated in a direction opposite the bias of the dextral biasing mechanism (640) to release the cooperation of the dextral leg engagement end (610) and the dextral leg engagement region storage location (322) such that the dextral leg engagement end (610) cooperates with the dextral leg engagement region transition region (326) as the dextral leg (600) pivots toward the operative position until the bias of the dextral biasing mechanism (640) results in the cooperation of the dextral leg engagement end (610) and the dextral leg engagement region operative location (324), and (b) to pivot the dextral leg (600) from the operative position to the recessed storage position the dextral leg (600) must be translated in a direction opposite the bias of the dextral biasing mechanism (640) to release the cooperation of the dextral leg engagement end (610) and the dextral leg engagement operative location (324) such that the dextral leg engagement end (610) cooperates with the dextral leg engagement region transition region (326) as the dextral leg (600) pivots toward the storage position until the bias of the dextral biasing mechanism (640) results in the cooperation of the dextral leg engagement end (610) and the dextral leg engagement region storage location (322);

d) a sinistral leg (800) in rotational and translational cooperation with the sinistral pivot (410) including a sinistral biasing mechanism (840), wherein the sinistral leg (800) has a sinistral leg engagement end (810), a sinistral leg roller end (820) that the sinistral biasing mechanism (840) biases toward the sinistral pivot (410), and a sinistral pivot slot (830) in cooperation with the sinistral pivot (410), and wherein the sinistral pivot slot (830) has a sinistral slot length (832), a sinistral slot storage position (834), and a sinistral slot transition region (836), such that;

(i) the sinistral leg (800) has a storage position fully recessed within the device (100) wherein the sinistral biasing mechanism (840) biases the sinistral slot storage position (834) to the sinistral pivot (410) thereby positioning the sinistral leg engagement end (810) in cooperation with the sinistral leg engagement region storage location (422);

(ii) the sinistral leg (800) has an operative position extending from the device (100) wherein the sinistral biasing mechanism (840) biases the sinistral leg roller end (820) toward the sinistral pivot (410) thereby positioning the sinistral leg engagement end (810) in cooperation with the sinistral leg engagement region operative location (424); and (iii) the sinistral leg (800) pivots about the sinistral pivot (410) to rotate from the recessed storage position to the operative position, and (a) to pivot the sinistral leg (800) from the recessed storage position to the operative position the sinistral leg (800) must be translated in a direction opposite the bias of the sinistral biasing mechanism (840) to release the cooperation of the sinistral leg engagement end (810) and the sinistral leg engagement region storage location (422) such that the sinistral leg engagement end (810) cooperates with the sinistral leg engagement region transition region (426) as the sinistral leg (800) pivots toward the operative position until the bias of the sinistral biasing mechanism (840) results in the cooperation of the sinistral leg engagement end (810) and the sinistral leg engagement region operative location (424); and (b) to pivot the sinistral leg (800) from the operative position to the recessed storage position the sinistral leg (800) must be translated in a direction opposite the bias of the sinistral biasing mechanism (840) to release the cooperation of the sinistral leg engagement end (810) and the sinistral leg engagement region operative location (424) such that the sinistral leg engagement end (810) cooperates with the sinistral leg engagement region transition region (426) as the sinistral leg (800) pivots toward the storage position until the bias of the sinistral biasing mechanism (840) results in the cooperation of the sinistral leg engagement end (810) and the sinistral leg engagement region storage location (422).

2. The fully recessed translation biased cantilever leg luggage device (100) of claim 1, further including a crossbar (1000) connecting the dextral leg (600) and the sinistral leg (800).

3. The fully recessed translation biased cantilever leg luggage device (100) of claim 2, further including a rotation prevention recess (500) formed in the luggage device (100), wherein the rotation prevention recess (500) cooperates with the crossbar (1000) connecting the dextral leg (600) and the sinistral leg (800) such that crossbar (1000) must be translationally displaced in a direction opposite the bias of the dextral biasing mechanism (640) and the sinistral biasing mechanism (840) by a rotation prevention recess minimum offset distance (530) to release the cooperation of the rotation prevention recess (500) and the crossbar (1000) and facilitate simultaneous movement of (a) the dextral leg engagement end (610) from the dextral leg engagement region operative location (324), and (b) the sinistral leg engagement end (810) from the sinistral leg engagement region operative location (424), to permit rotation of the dextral leg (600) and the sinistral leg (800) from the recessed storage position to the operative position.

4. The fully recessed translation biased cantilever leg luggage device (100) of claim 3, wherein the rotation prevention recess (500) forms a gripping recess (520) sized to permit a human hand to grip the recessed crossbar (1000) and apply a reverse bias force to translate the crossbar (1000) free of the rotation prevention recess (500).

5. The fully recessed translation biased cantilever leg luggage device (100) of claim 4, wherein the rotation prevention recess (500) includes a rotation prevention ledge (510).

6. The fully recessed translation biased cantilever leg luggage device (100) of claim 5, wherein the rotation prevention ledge (510) includes a dextral rotation prevention ledge (512) and a sinistral rotation prevention ledge (514).

7. The fully recessed translation biased cantilever leg luggage device (100) of claim 1, further including a dextral leg translation assistance device (700) and a sinistral leg translation assistance device (900), wherein the dextral leg translation assistance device (700) promotes reduced friction movement of the dextral leg engagement end (610) through the dextral leg engagement region transition region (326), and the sinistral leg translation assistance device (900) promotes reduced friction movement of the sinistral leg engagement end (810) through the sinistral leg engagement region transition region (426).

8. The fully recessed translation biased cantilever leg luggage device (100) of claim 7, wherein the dextral leg translation assistance device (700) includes a dextral leg engagement end roller (710) rotably mounted to the dextral leg engagement end (610), and the sinistral leg translation assistance device (900) includes a sinistral leg engagement end roller (910) rotably mounted to the sinistral leg engagement end (810).

9. The fully recessed translation biased cantilever leg luggage device (100) of claim 1, further including a dextral roller (1100) attached to the dextral leg roller end (620), and a sinistral roller (1200) attached to the sinistral leg roller end (820).

10. The fully recessed translation biased cantilever leg luggage device (100) of claim 9, wherein the dextral roller (1100) is a dextral caster (1110), and the sinistral roller (1200) is a sinistral caster (1210).

11. The fully recessed translation biased cantilever leg luggage device (100) of claim 1, further including at least one base roller (1300) located at a corner edge of the luggage device (100) and separated from an axis of the dextral pivot (310) and the sinistral pivot (410) by a base roller to pivot distance (1310).

12. A fully recessed translation biased cantilever leg luggage device (100), comprising:

a) a dextral leg recess (300) having a dextral recess leg engagement region (320), a dextral leg storage region (330), and a dextral pivot (310), wherein the dextral recess leg engagement region (320) includes:

(i) a dextral leg engagement region storage location (322);

(ii) a dextral leg engagement region operative location (324); and (iii) a dextral leg engagement region transition region (326);

b) a sinistral leg recess (400) having a sinistral recess leg engagement region (420), a sinistral leg storage region (430), and a sinistral pivot (410), wherein the sinistral recess leg engagement region (420) includes:

(i) a sinistral leg engagement region storage location (422);

(ii) a sinistral leg engagement region operative location (424); and (iii) a sinistral leg engagement region transition region (426);

c) a dextral leg (600) in rotational and translational cooperation with the dextral pivot (310) including a dextral biasing mechanism (640), wherein the dextral leg (600) has a dextral leg engagement end (610), a dextral leg roller end (620) that the dextral biasing mechanism (640) biases toward the dextral pivot (610), the dextral leg roller end (820) having a dextral caster (1110)

attached thereto, and a dextral pivot slot (630) in cooperation with the dextral pivot (310), wherein the dextral pivot slot (630) has a dextral slot length (632), a dextral slot storage position (634), and a dextral slot transition region (636), such that;

(i) the dextral leg (600) has a storage position fully recessed within the device (100) wherein the dextral biasing mechanism (640) biases the dextral slot storage position (634) to the dextral pivot (310) thereby positioning the dextral leg engagement end (610) in cooperation with the dextral leg engagement region storage location (322);

(ii) the dextral leg (600) has an operative position extending from the device (100) wherein the dextral biasing mechanism (640) biases the dextral leg roller end (620) toward the dextral pivot (310) thereby positioning the dextral leg engagement end (610) in cooperation with the dextral leg engagement region operative location (324); and (iii) the dextral leg (600) pivots about the dextral pivot (310) to rotate from the recessed storage position to the operative position, and (a) to pivot the dextral leg (600) from the recessed storage position to the operative position the dextral leg (600) must be translated in a direction opposite the bias of the dextral biasing mechanism (640) to release the cooperation of the dextral leg engagement end (610) and the dextral leg engagement region storage location (322) such that the dextral leg engagement end (610) cooperates with the dextral leg engagement region transition region (326) as the dextral leg (600) pivots toward the operative position until the bias of the dextral biasing mechanism (640) results in the cooperation of the dextral leg engagement end (610) and the dextral leg engagement region operative location (324), and (b) to pivot the dextral leg (600) from the operative position to the recessed storage position the dextral leg (600) must be translated in a direction opposite the bias of the dextral biasing mechanism (640) to release the cooperation of the dextral leg engagement end (610) and the dextral leg engagement operative location (324) such that the dextral leg engagement end (610) cooperates with the dextral leg engagement region transition region (326) as the dextral leg (600) pivots toward the storage position until the bias of the dextral biasing mechanism (640) results in the cooperation of the dextral leg engagement end (610) and the dextral leg engagement region storage location (322);

d) a sinistral leg (800) in rotational and translational cooperation with the sinistral pivot (410) including a sinistral biasing mechanism (840), wherein the sinistral leg (800) has a sinistral leg engagement end (810), a sinistral leg roller end (820) that the sinistral biasing mechanism (840) biases toward the sinistral pivot (410), the sinistral leg roller end (820) having a sinistral caster (1210) attached thereto, and a sinistral pivot slot (830) in cooperation with the sinistral pivot (410), wherein the sinistral pivot slot (830) has a sinistral slot length (832), a sinistral slot storage position (834), and a sinistral slot transition region (836), such that;

(i) the sinistral leg (800) has a storage position fully recessed within the device (100) wherein the sinistral biasing mechanism (840) biases the sinistral slot storage position (834) to the sinistral pivot (410) thereby positioning the sinistral leg engagement end (810) in cooperation with the sinistral leg engagement region storage location (422);

(ii) the sinistral leg (800) has an operative position extending from the device (100) wherein the sinistral biasing mechanism (840) biases the sinistral leg roller end (820) toward the sinistral pivot (410) thereby positioning the sinistral leg engagement end (810) in cooperation with the sinistral leg engagement region operative location (424); and (iii) the sinistral leg (800) pivots about the sinistral pivot (410) to rotate from the recessed storage position to the operative position, and (a) to pivot the sinistral leg (800) from the recessed storage position to the operative position the sinistral leg (800) must be translated in a direction opposite the bias of the sinistral biasing mechanism (840) to release the cooperation of the sinistral leg engagement end (810) and the sinistral leg engagement region storage location (422) such that the sinistral leg engagement end (810) cooperates with the sinistral leg engagement region transition region (426) as the sinistral leg (800) pivots toward the operative position until the bias of the sinistral biasing mechanism (840) results in the cooperation of the sinistral leg engagement end (810) and the sinistral leg engagement region operative location (424), and (b) to pivot the sinistral leg (800) from the operative position to the recessed storage position the sinistral leg (800) must be translated in a direction opposite the bias of the sinistral biasing mechanism (840) to release the cooperation of the sinistral leg engagement end (810) and the sinistral leg engagement region operative location (424) such that the sinistral leg engagement end (810) cooperates with the sinistral leg engagement region transition region (426) as the sinistral leg (800) pivots toward the storage position until the bias of the sinistral biasing mechanism (840) results in the cooperation of the sinistral leg engagement end (810) and the sinistral leg engagement region storage location (422);

e) a crossbar (1000) connecting the dextral leg (600) and the sinistral leg (800); and f) at least one base roller (1300) located at a corner edge of the luggage device (100) and separated from an axis of the dextral pivot (310) and the sinistral pivot (410) by a base roller to pivot distance (1310).

13. The fully recessed translation biased cantilever leg luggage device (100) of claim 12, further including a rotation prevention recess (500) formed in the luggage device (100), wherein the rotation prevention recess (500) cooperates with the crossbar (1000) connecting the dextral leg (600) and the sinistral leg (800) such that crossbar (1000) must be translationally displaced in a direction opposite the bias of the dextral biasing mechanism (640) and the sinistral biasing mechanism (840) by a rotation prevention recess minimum offset distance (530) to release the cooperation of the rotation prevention recess (500) and the crossbar (1000) and facilitate simultaneous movement of (a) the dextral leg engagement end (610) from the dextral leg engagement region operative location (324), and (b) the sinistral leg engagement end (810) from the sinistral leg engagement region operative location (424), to permit rotation of the dextral leg (600) and the sinistral leg (800) from the recessed storage position to the operative position.

14. The fully recessed translation biased cantilever leg luggage device (100) of claim 13, wherein the rotation prevention recess (500) forms a gripping recess (520) sized to permit a human hand to grip the recessed crossbar (1000) and apply a reverse bias force to translate the crossbar (1000) free of the rotation prevention recess (500).

15. The fully recessed translation biased cantilever leg luggage device (100) of claim 14, wherein the rotation prevention recess (500) includes a rotation prevention ledge (510).

16. The fully recessed translation biased cantilever leg luggage device (100) of claim 15, wherein the rotation prevention ledge (510) includes a dextral rotation prevention ledge (512) and a sinistral rotation prevention ledge (514).

17. The fully recessed translation biased cantilever leg luggage device (100) of claim 12, further including a dextral leg translation assistance device (700) and a sinistral leg translation assistance device (900), wherein the dextral leg translation assistance device (700) promotes reduced friction movement of the dextral leg engagement end (610) through the dextral leg engagement region transition region (326), and the sinistral leg translation assistance device (900) promotes reduced friction movement of the sinistral leg engagement end (810) through the sinistral leg engagement region transition region (426).

18. The fully recessed translation biased cantilever leg luggage device (100) of claim 17, wherein the dextral leg translation assistance device (700) includes a dextral leg engagement end roller (710) rotably mounted to the dextral leg engagement end (610), and the sinistral leg translation assistance device (900) includes a sinistral leg engagement end roller (910) rotably mounted to the sinistral leg engagement end (810).

19. A fully recessed translation biased cantilever leg luggage device (100), comprising:

a) a dextral leg recess (300) having a dextral recess leg engagement region (320), a dextral leg storage region (330), and a dextral pivot (310), wherein the dextral recess leg engagement region (320) includes:
   (i) a dextral leg engagement region storage location (322);
   (ii) a dextral leg engagement region operative location (324); and
   (iii) a dextral leg engagement region transition region (326);

b) a sinistral leg recess (400) having a sinistral recess leg engagement region (420), a sinistral leg storage region (430), and a sinistral pivot (410), wherein the sinistral recess leg engagement region (420) includes:
   (i) a sinistral leg engagement region storage location (422);
   (ii) a sinistral leg engagement region operative location (424); and
   (iii) a sinistral leg engagement region transition region (426);

c) a dextral leg (600) in rotational and translational cooperation with the dextral pivot (310) including a dextral biasing mechanism (640), wherein the dextral leg (600) has a dextral leg engagement end (610), a dextral leg roller end (620) that the dextral biasing mechanism (640) biases toward the dextral pivot (610), the dextral leg roller end (820) having a dextral caster (1110) attached thereto, and a dextral pivot slot (630) in cooperation with the dextral pivot (310), wherein the dextral pivot slot (630) has a dextral slot length (632), a dextral slot storage position (634), and a dextral slot transition region (636), such that;
   (i) the dextral leg (600) has a storage position fully recessed within the device (100) wherein the dextral biasing mechanism (640) biases the dextral slot storage position (634) to the dextral pivot (310) thereby positioning the dextral leg engagement end (610) in cooperation with the dextral leg engagement region storage location (322);
   (ii) the dextral leg (600) has an operative position extending from the device (100) wherein the dextral biasing mechanism (640) biases the dextral leg roller end (620) toward the dextral pivot (310) thereby positioning the dextral leg engagement end (610) in cooperation with the dextral leg engagement region operative location (324); and
   (iii) the dextral leg (600) pivots about the dextral pivot (310) to rotate from the recessed storage position to the operative position, and
      (a) to pivot the dextral leg (600) from the recessed storage position to the operative position the dextral leg (600) must be translated in a direction opposite the bias of the dextral biasing mechanism (640) to release the cooperation of the dextral leg engagement end (610) and the dextral leg engagement region storage location (322) such that the dextral leg engagement end (610) cooperates with the dextral leg engagement region transition region (326) as the dextral leg (600) pivots toward the operative position until the bias of the dextral biasing mechanism (640) results in the cooperation of the dextral leg engagement end (610) and the dextral leg engagement region operative location (324), and
      (b) to pivot the dextral leg (600) from the operative position to the recessed storage position the dextral leg (600) must be translated in a direction opposite the bias of the dextral biasing mechanism (640) to release the cooperation of the dextral leg engagement end (610) and the dextral leg engagement operative location (324) such that the dextral leg engagement end (610) cooperates with the dextral leg engagement region transition region (326) as the dextral leg (600) pivots toward the storage position until the bias of the dextral biasing mechanism (640) results in the cooperation of the dextral leg engagement end (610) and the dextral leg engagement region storage location (322);

d) a sinistral leg (800) in rotational and translational cooperation with the sinistral pivot (410) including a sinistral biasing mechanism (840), wherein the sinistral leg (800) has a sinistral leg engagement end (810), a sinistral leg roller end (820) that the sinistral biasing mechanism (840) biases toward the sinistral pivot (410), the sinistral leg roller end (820) having a sinistral caster (1210) attached thereto, and a sinistral pivot slot (830) in cooperation with the sinistral pivot (410), wherein the sinistral pivot slot (830) has a sinistral slot length (832), a sinistral slot storage position (834), and a sinistral slot transition region (836), such that;
   (i) the sinistral leg (800) has a storage position fully recessed within the device (100) wherein the sinistral biasing mechanism (840) biases the sinistral slot storage position (834) to the sinistral pivot (410) thereby positioning the sinistral leg engagement end (810) in cooperation with the sinistral leg engagement region storage location (422);
   (ii) the sinistral leg (800) has an operative position extending from the device (100) wherein the sinistral biasing mechanism (840) biases the sinistral leg roller end (820) toward the sinistral pivot (410) thereby positioning the sinistral leg engagement end (810) in cooperation with the sinistral leg engagement region operative location (424); and (iii) the sinistral leg (800) pivots about the sinistral pivot (410) to rotate from the recessed storage position to the operative position, and (a) to pivot the sinistral leg (800) from the recessed storage position to the operative position the sinistral leg (800) must be translated in a direction opposite the bias of the sinistral biasing mechanism (840) to release the cooperation of the sinistral leg engagement end (810) and the sinistral leg engagement region storage location (422) such that the sinistral leg engagement end (810) cooperates with the sinistral leg engagement region transition region (426) as the sinistral leg (800) pivots toward the operative position until the bias of the sinistral biasing mechanism (840) results in the cooperation of the sinistral leg engagement end (810) and the sinistral leg engagement region operative location (424), and (b) to pivot the sinistral leg (800) from the operative position to the recessed storage position the sinistral leg (800) must be translated in a direction opposite the bias of the sinistral biasing mechanism (840) to release the cooperation of the sinistral leg engagement end (810) and the sinistral leg engagement region operative location (424) such that the sinistral leg engagement end (810) cooperates with the sinistral leg engagement region transition region (426) as the sinistral leg (800) pivots toward the storage position until the bias of the sinistral biasing mechanism (840) results in the cooperation of the sinistral leg engagement end (810) and the sinistral leg engagement region storage location (422);

e) a crossbar (1000) connecting the dextral leg (600) and the sinistral leg (800);

f) at least one base roller (1300) located at a corner edge of the luggage device (100) and separated from an axis of the dextral pivot (310) and the sinistral pivot (410) by a base roller to pivot distance (1310);

g) a rotation prevention recess (500), the rotation prevention recess (500) including a rotation prevention ledge (510), wherein (i) the rotation prevention recess (500) cooperates with the crossbar (1000) such that crossbar (1000) must be translationally displaced in a direction opposite the bias of the dextral biasing mechanism (640) and the sinistral biasing mechanism (840) by a rotation prevention recess minimum offset distance (530) to release the cooperation of the rotation prevention recess (500) and the crossbar (1000) and facilitate simultaneous movement of (a) the dextral leg engagement end (610) from the dextral leg engagement region operative location (324), and (b) the sinistral leg engagement end (810) from the sinistral leg engagement region operative location (424), to permit rotation of the dextral leg (600) and the sinistral leg (800) from the recessed storage position to the operative position; and (ii) the rotation prevention recess (500) forms a gripping recess (520) sized to permit a human hand to grip the recessed crossbar (1000) and apply a reverse bias force to translate the crossbar (1000) free of the rotation prevention recess (500); and h) a dextral leg translation assistance device (700) having a dextral leg engagement end roller (710) rotably mounted to the dextral leg engagement end (610), and a sinistral leg translation assistance device (900) having a sinistral leg engagement end roller (910) rotably mounted to the sinistral leg engagement end (810), wherein the dextral leg translation assistance device (700) promotes reduced friction movement of the dextral leg engagement end (610) through the dextral leg engagement region transition region (326), and the sinistral leg translation assistance device (900) promotes reduced friction movement of the sinistral leg engagement end (810) through the sinistral leg engagement region transition region (426).

* * * * *